United States Patent [19]

Guillermin et al.

[11] 4,175,157

[45] Nov. 20, 1979

[54] PROCESS FOR TEXTURIZING POLYESTER YARN AND YARN

[75] Inventors: Rene Guillermin, Bron; Jean Joly, Craponne; Silvio Sangalli, Caluire, all of France

[73] Assignee: Rhone-Poulenc Textile, Paris, France

[21] Appl. No.: 824,615

[22] Filed: Aug. 15, 1977

Related U.S. Application Data

[63] Continuation of Ser. No. 724,848, Sep. 20, 1976, abandoned, which is a continuation-in-part of Ser. No. 557,088, Mar. 10, 1975, abandoned.

[30] Foreign Application Priority Data

Mar. 22, 1974 [FR] France ..... 74 10429

[51] Int. Cl.[2] ..... D02G 1/12; D02G 1/16; D02G 1/20

[52] U.S. Cl. ..... 428/369; 28/221; 28/255; 28/258; 28/263

[58] Field of Search ..... 28/221, 255, 256, 258, 28/262, 267, 271, 263; 428/362, 369

[56] References Cited

U.S. PATENT DOCUMENTS

| | | | |
|---|---|---|---|
| 2,647,285 | 8/1953 | Pfau | 28/258 X |
| 3,036,357 | 5/1962 | Cook et al. | 28/256 |
| 3,373,470 | 3/1968 | Joly | 28/255 |

*Primary Examiner*—Louis Rimrodt

*Attorney, Agent, or Firm*—Stevens, Davis, Miller & Mosher

[57] ABSTRACT

A process for the preparation of texturized multifilamentary polyester yarn possessing a stable crimp, in which the yarn passes first through a crimping device comprising an injector where the yarn is subjected to a stream of hot fluid which separates the filaments, and thereafter through a stacking nozzle to cause crimping, characterized in that the fluid is fed in at a temperature below the second order transition temperature of the polyester yarn, which feeding temperature is usually between 95° and 220° C., and in that the stack, after it issues from the nozzle is kept in the compressed state, subjected in this state to a high pressure of the order of 20 to 200 kg/cm$^2$, and kept at ambient temperature or subjected to a heat treatment at a temperature below the second order transition temperature of the polyester yarn, which is usually at a temperature of up to about 220° C., for a period of time ranging from one minute to 150 minutes.

Polyester yarn possessing a stable crimp and fiber prepared by cutting the said yarn, as well as the textile articles comprising this yarn are also disclosed.

13 Claims, 6 Drawing Figures

PROCESS FOR TEXTURIZING POLYESTER YARN AND YARN

This is a continuation of application Ser. No. 724,848 filed Sept. 20, 1976 which in turn is a continuation-in-part application of Ser. No. 557,088 filed Mar. 10, 1975, both now abandoned.

The present invention relates to a process for texturizing polyester yarn and the yarn obtained by this process.

Continuous polyester yarns are often texturized with a view of using them in the weaving industry and in the hosiery trade; this texturizing generally makes use of the false twist process which makes it possible to prepare a yarn which possesses a certain elasticity, the bulk of the yarn making it possible to improve the handle of the article. For some applications, however, the main property sought is bulk, manifesting itself in a puffed-out appearance of the yarn, particularly when it is desired to produce floor coverings.

It is known to crimp polyester yarns by means of other processes such as the pneumatic process described, for example, in U.S. Pat. No. 3,438,105 assigned to the present applicants' assignee, in which the multifilament yarn is subjected to a stream of hot fluid which separates the filaments and then stacks the whole in a restricted space from which it issues freely in the crimped state; however, the treatment with the hot fluid causes considerable shrinkage of the filaments, and this changes their tensiometric characteristics in such a way that their elongation at break increases greatly and their tensile strength is consequently reduced. This change manifests itself in subsequent deformations of the articles in the form of knitted or woven fabrics produced by means of the yarns; moreover, these deformations remove the crimp of the yarns and thus present the danger of cancelling out the desired effect; furthermore, because of the fragile nature of the crimp, which can be removed by simply exerting a tensile force on the yarn, great care must be taken when handling the said yarn when it is being wound up continuously in accordance with the above mentioned process, and during subsequent conversion operations.

The present invention provides a process which makes it possible to avoid the above mentioned disadvantages and to prepare a texturized polyester yarn possessing a stable crimp.

This process is characterized in that after having texturized the polyester yarn by means of a fluid as disclosed in the above-mentioned patent and wherein the fluid is kept below the second order transition temperature of the polyester yarn, usually at a temperature between 95° and 220° C., the stack obtained is kept under compression, subjected to a high pressure, preferably between 20 and 200 kg/cm$^2$, and kept at ambient temperatures or subjected to an elevated temperature still below the second order transition temperature of this polyester yarn, such as up to about 220° C., for a period of time ranging from one minute to 150 minutes. After this treatment, the mass of stacked yarn has become homogeneous and compact. This compact homogenerous mass can be delivered directly to the customer who can draw from it the yarn which can be used for textile operations; it is also possible to draw the yarn from the compact homogeneous mass and to wind it up in a conventional manner. The operations described above, of stacking, compressing and heat-treating the yarn can be carried out continuously or discontinuously. When they are carried out continuously, it is possible to thereafter knit or weave the yarn drawn from the compressed package.

By "polyester yarn", there is to be understood a yarn which is wholly or partially stretched. This stretching process can be carried out in one or more operations, continuously or discontinuously, when the yarn is being manufactured. The polyester used in preferably that obtained by polymerizing ethylene glycol terephthalate, but other stretched or partially stretched polyester yarn can be used. The yarn is of any gauge or cross-section, and may or may not be colored.

The stacking process if preferably carried out at a temperature of between 95° and 220° C., but in any event below the second order transition temperature of the polyester yarn, in order to heat the yarn to a sufficient extent to make it easier to fold over the strands and to stack the whole. The stacked yarn is subjected thereafter to a pressure treatment and optionally a heat treatment, the pressure treatment and the heat treatment being carried out simultaneously or successively, continuously or discontinuously.

The purpose of the pressure treatment is to keep the length of the yarn constant, so as to prevent it from shrinking during the heat treatment. Consequently, the heat treatment for stabilizing the crimp has the same effect as a conventional heat treatment for effecting dimensional stabilization under tension. The pressure device can be of any known type, such as pistons, endless belts, calenders, mechanical presses, inflatable chambers and the like.

The yarn obtained possesses a crimped and puffed-out appearance; the filaments of which it is formed possesses deformations which are distributed at random and are of several types, namely the crimps which are distributed along the yarn and are grouped in zones separated by zones of flatter yarn, on the one hand, and the deformations due to the effect of the pressure means on the yarn, on the other hand. The yarn can also possess deformations in its transverse cross-section. It is found that the heat treatment of the yarn stabilizes the latter dimensionally, although this treatment of the yarn is carried out on the said yarn in the folded state, due to the blocking by the pressure exerted.

The present invention is further illustrated with reference to the drawings wherein:

FIGS. 1 to 3 diagrammatically illustrates an example of the way in which the various stages of the present process are carried out.

Figure 1:
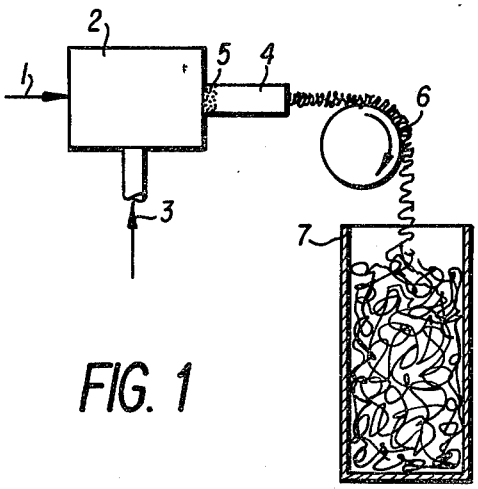
Figure 2:
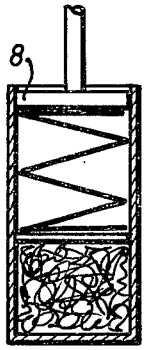
Figure 3:
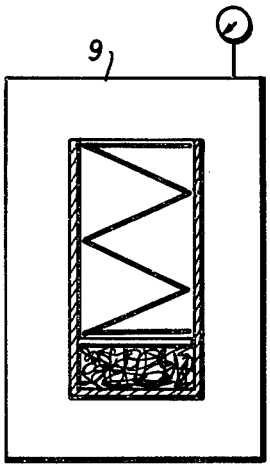
Figure 4:
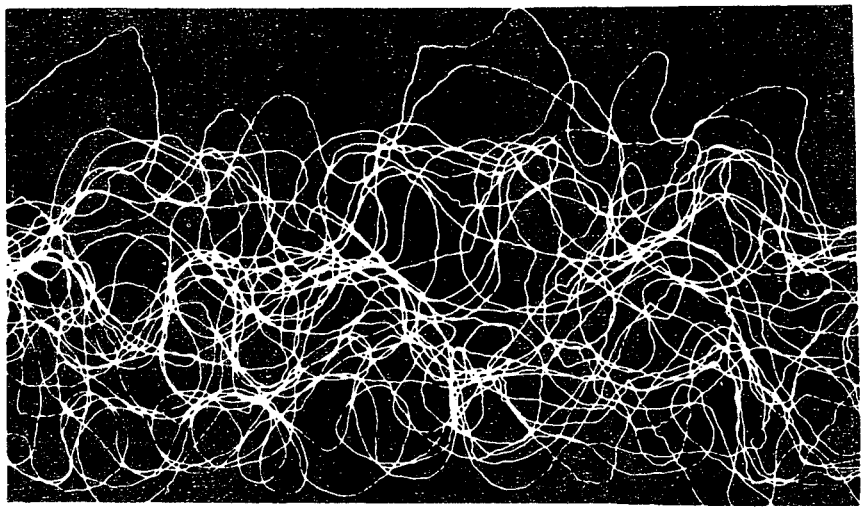
FIG. 4 illustrates texturized polyester filaments obtained by carrying out the process according to the present invention.
Figure 5:
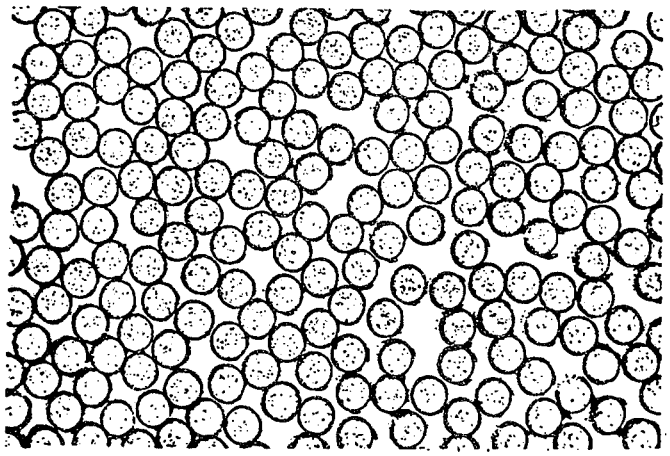
FIGS. 5 and 6 illustrate the yarns in transverse cross-section, respectively before and after treatment.
Figure 6:
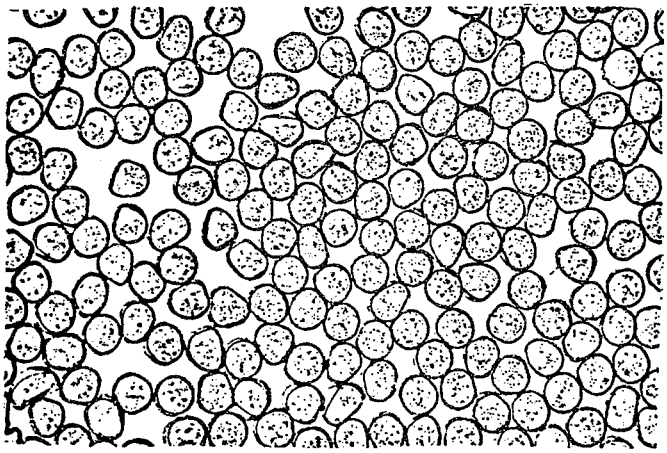

Referring to FIGS. 1 to 3, the yarn 1, coming from a feed device which is not represented, enters an injector 2 in which it is subjected to a stream of hot fluid 3 which opens the filaments, but is not at a temperature higher than the second order transition temperature of the yarns or filaments. The filaments then enter a nozzle 4 which has orifices 5 pierced through its side; a part of the fluid escapes through these orifices and the other part ensures that the stack 6 is formed in and moves forward through the nozzle. At the outlet of the nozzle, the said stack is deposited in a cylindrical receptacle 7 (FIG. 1); when the receptacle is full, it is placed under the platen of a press 8 (FIG. 2) which converts the stacked packet of yarn into a compressed package. The receptacle and the package, kept under compression, are then subjected to heat treatment to a temperature below the second order transition temperature of the polyester yarn, in an oven 9 (FIG. 3). The latter heating treatment may be omitted. After the treatment and after cooling, the package of stacked yarn is withdrawn from the receptacle. The yarn is drawn from the package obtained; it has the appearance shown in FIG. 4.

The texturized yarn thus obtained can be used in the form of continuous yarn or can be cut up and used in the form of fiber, for any textile applications.

The following examples are provided to further illustrate the present invention only, and the invention is in no way to be deemed as limited thereby.

EXAMPLE 1

A poly(ethylene glycol terephthalate) yarn, of 167 dtex/30 strands, stretched in a ratio of 4.5 supplies a crimping device as described in U.S. Pat. No. 3,438,105 which description is incorporated here by reference under the following conditions:

Rate of Feed—500 meters/minute
Nature of the fluid—steam
Pressure of the fluid—3 kg/cm$^2$
Diameter of the nozzle—3 mm
Rate at which the stack issues—6 meters/minute.

At the outlet of the nozzle the stack is deposited at the rate of 15 meters/minute in a container consisting of a metal cylinder of diameter 72 mm and height 40 cm, and is then subjected to a pressure of 130 kg/cm$^2$; the compressed package obtained is then heat-treated in a hot air medium for 60 minutes at 200° C. After the homogeneous hard compact package obtained has been cooled, the yarn is drawn off. The comparative properties of the treated yarn and of an untreated control yarn are as shown in the following Table I.

TABLE I

| Yarn | Gauge dtex/ number of strands | Tensile strength g/den | Elongation % | Shrinkage in boiling water % | Elasticity % | Bulk cm$^3$/g | Crimp, number of ½ waves/ cm |
|---|---|---|---|---|---|---|---|
| Control yarn | 167/30 | 4.8 | 18.9 | 7.75 | 0.88 | 1.95 | |
| Texturized yarn | 199/30 | 3.2 | 25.4 | 0.45 | 45 | 6.39 | 11 |

It is thus seen that the properties have been changed to give practically zero shrinkage in boiling water but high elasticity and high bulk; the yarn, blocked dimensionally because of the violent transverse compression force and the heat treatment, possesses a stable crimp which is removed only when a very high tensile force is exerted on this yarn. The purpose of the tests, the results of which are indicated below in Table II, is to illustrate this crimp stability; they compare the crimp stability, under different loads, of the yarn obtained according to the present process and of the yarn taken from the stack at the outlet of the crimping device.

TABLE II

| Load in g/dtex | | 0 | 0.5 | 0.75 | 1 | 1.25 | 1.5 |
|---|---|---|---|---|---|---|---|
| Yarn taken at the outlet of the device | Crimp contraction % | −3.7 | −1 | −0.2 | +0.3 | +2 | +2 |
| Yarn according to present process | | −47.3 | −35 | −14.6 | −28 | −14 | −55 |

The crimp contraction is measured in accordance with a method wherein a skein is prepared having a length of 50 cm by coiling 8 turns of yarn, each of one meter, under a tension of 0.1 g/dtex. A load is applied for one minute, consisting of a weight suspended at one end of the skein, that is to say, in the case of a skein of yarn of 167 dtex/30 strands at 1 g/dtex, the corresponding load is 2,672 g.

The load is removed after one minute; the skein is immersed for five minutes in a graduated wide-mouthed vessel containing water at 90° C., and the difference in length between the length of the skein before applying the load and the length of the skein after immersion in water is measured and multiplied by two in order to bring the said measurement to one meter.

By examining the results, it can be seen easily that the crimp in the yarn of this invention persists while the yarn taken at the outlet of the crimping device begins to flow under a load of between 0.75 and 1 g/dtex.

EXAMPLE 2

A poly(ethylene glycol terephthalate) yarn, of 550 dtex/60 strands, stretched in a ratio of 4.5, is introduced into and texturized in a crimping device like that described in U.S. Pat. No. 3,438,105, under the following conditions:

Rate at which the yarn is fed to the injector—2,000 meters/minute
Nature of the fluid—saturated steam
Pressure of the fluid—5 kg/cm$^2$
Diameter of the nozzle—8 mm
Rate at which the stack issues—30 meters/minute At the outlet of the nozzle, the stack is deposited at a rate of 35 meters/minute in a receptacle consisting of a cylinder of diameter 72 mm and height 40 cm, and is then subjected to a pressure of 140 kg/cm$^2$; the compressed package obtained is then heat-treated at 145° C., in saturated steam for 20 minutes. After cooling the package obtained, the yarn is drawn off. The comparative properties of the yarn before and after treatment are as shown in the following Table III.

TABLE III

| Yarn | Gauge dtex/ number of strands | Strength R.k.m. | Elongation % | shrinkages % Boiling water | Steam 130° C. | Dry air 150° C. | Elasticity % | Bulk % | Crimp, number of ½ waves cm. |
|---|---|---|---|---|---|---|---|---|---|
| Control yarn | 550 dtex/ 60 strands | 35 | 15 | 8 | 13 | 9 | — | — | — |
| Treated yarn | 574 dtex/ 60 strands | 22 | 20.4 | 0.3 | 0.8 | 0.2 | 27.1 | 3.96 | 7 |

While the present invention has been illustrated primarily with regard to the foregoing exemplification, it should be obvious that the present invention is not in any way to be deemed as limited thereto, but must be construed as broadly as all or any equivalents thereof.

What is claimed is:

1. A process for the preparation of texturized multifilament polyester yarn possessing a stable crimp, by crimping and compressing the said yarn, in which the yarn passes first through an injector where it is subjected to a stream of hot fluid which separates the filaments, and thereafter through a stacking nozzle to cause crimping, wherein the fluid is fed into the injector at a temperature below the second order transition temperature of said polyester yarn, the stack, after it issues from the nozzle is kept in the compressed state, subjected in this state to a high pressure of the order of 20 to 200 kg/cm$^2$, and kept at a temperature below the second order transition temperature of said polyester yarn for a period of time ranging from one minute to 150 minutes.

2. The process of claim 1, wherein the fluid is fed into the injector at a temperature between 95° and 220° C.

3. A texturized multifilament polyester yarn made by the process of claim 2.

4. A stack of texturized multifilament polyester yarn made by the process of claim 2.

5. The process of claim 1, wherein the stack is kept at ambient temperature for said period of time.

6. A texturized multifilament polyester yarn made by the process of claim 5.

7. A stack of texturized multifilament polyester yarn made by the process of claim 3.

8. The process of claim 1, wherein the stack is heat treated at a temperature of up to about 220° C. for said period of time.

9. A texturized multifilament polyester yarn made by the process of claim 8.

10. A stack of texturized multifilament polyester yarn made by the process of claim 8.

11. The process of claim 1 wherein the stack is subjected to said high pressure by mechanically compressing the stack.

12. A texturized multifilament polyester yarn made by the process of claim 1.

13. A stack of texturized multifilament polyester yarn made by the process of claim 1.

* * * * *